United States Patent [19]

Bretz

[11] 4,331,448

[45] May 25, 1982

[54] GASIFICATION REACTOR AND FEED APPARATUS

[75] Inventor: George M. Bretz, Verona, Pa.

[73] Assignee: Koppers Company, Inc., Pittsburgh, Pa.

[21] Appl. No.: 237,101

[22] Filed: Feb. 23, 1981

[51] Int. Cl.[3] ..... C10J 3/30

[52] U.S. Cl. ..... 48/86 A; 48/77; 222/272; 222/368; 414/176; 414/189; 422/193; 422/232

[58] Field of Search ..... 48/77, 86 A; 222/254, 222/272, 368; 414/173, 176, 189, 195, 198, 219, 220; 422/189, 193, 232, 233

[56] References Cited

U.S. PATENT DOCUMENTS

| | | | |
|---|---|---|---|
| 945,715 | 1/1910 | Gow | 48/86 A |
| 1,866,730 | 7/1932 | Sperr | 48/86 A |
| 2,501,153 | 3/1950 | Berg | 48/86 A |
| 2,627,455 | 2/1953 | Berg | 414/198 |
| 3,077,272 | 2/1963 | Reinhall | 222/368 |
| 4,249,855 | 2/1981 | Dhandt | 48/86 A |

FOREIGN PATENT DOCUMENTS

| | | | |
|---|---|---|---|
| 77677 | 4/1963 | Czechoslovakia | 222/368 |
| 259448 | 6/1912 | Fed. Rep. of Germany | 48/86 A |

*Primary Examiner*—Peter F. Kratz
*Attorney, Agent, or Firm*—Donald M. Mac Kay

[57] ABSTRACT

The novel gasification reactor comprises a vertically oriented chamber with an upper pyrolysis section, a lower feed opening, and a primary combustion section. A lateral passage on each side and near the top of said primary combustion section each communicates with a separate secondary reaction chamber where a partially reacted feed is further reacted to form the product gas. In each passageway is a venturi nozzle or preferably a plurality of nozzles which accelerates the gas carrying entrained carbonaceous materials to produce a swirling curvilinear motion in the secondary reaction chambers.

The reactor is fed by means of a plurality of hoppers and screw conveyors whereby the flow is regulated and positively fed both by gravity and the screw conveyors into rotary valve cavities in which counter rotating valves travel. The valves feed a piston which charges the reactor.

10 Claims, 4 Drawing Figures

GASIFICATION REACTOR AND FEED APPARATUS

BACKGROUND OF THE INVENTION

This invention relates to a novel gasification reactor for converting coal and other carbonaceous materials to a gaseous mixture containing substantial amounts of carbon monoxide and hydrogen, which can be used in industrial processes to reduce ores, produce hydrocarbons, methanol, ammonia and the like; and to a novel feed apparatus.

Typical prior art apparatus and methods are illustrated in U.S. Pat. Nos. 4,013,428; 4,017,272; 4,042,344; 4,157,245; and 4,095,960.

BRIEF DESCRIPTION OF THE INVENTION

The novel gasification reactor comprises a vertically oriented chamber with an upper pyrolysis section, a lower feed opening, and a primary combustion section. A lateral passage on each side and near the top of said primary combustion section each communicates with a separate secondary reaction chamber where a partially reacted feed is further reacted to form the product gas. In each passageway is a venturi nozzle block or preferably a plurality of nozzle blocks which accelerate the gas carrying entrained carbonaceous materials to produce a swirling curvilinear motion in the secondary reaction chambers.

The reactor is fed by means of a plurality of hoppers and screw conveyors whereby the flow is regulated and positively fed both by gravity and the screw conveyors into rotary valve cavities in which counter rotating valves travel. The valves feed a piston which charges the reactor.

DETAILED DESCRIPTION OF THE INVENTION

Figure 1:
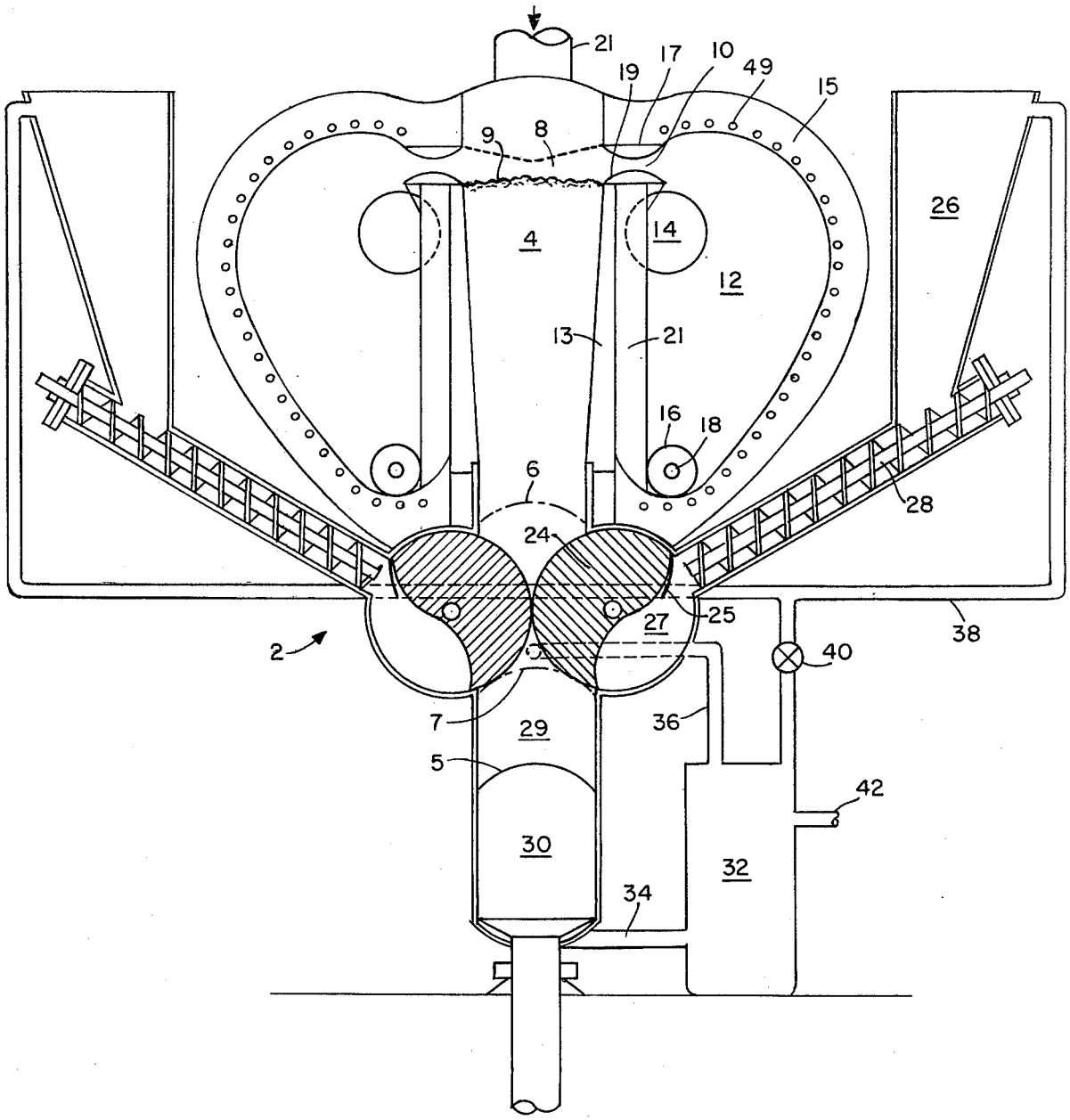
FIG. 1 is a cross sectional view of the gasification reactor of the invention, and the feed apparatus.
Figure 2:
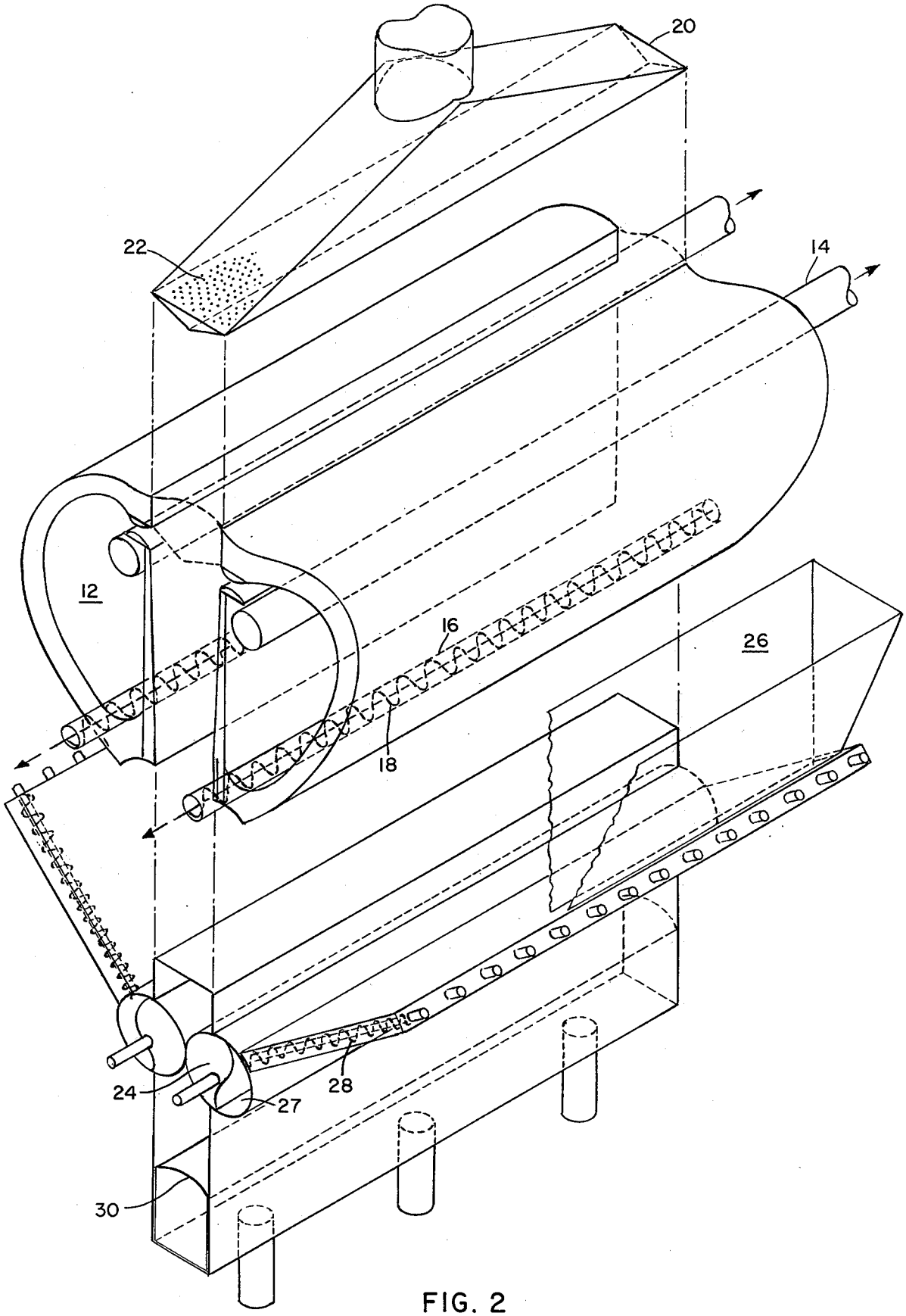
FIG. 2 is a perspective view depicting the gas diffusion plate, the secondary reaction chamber, and the carbonaceous feed system.
Figure 3:
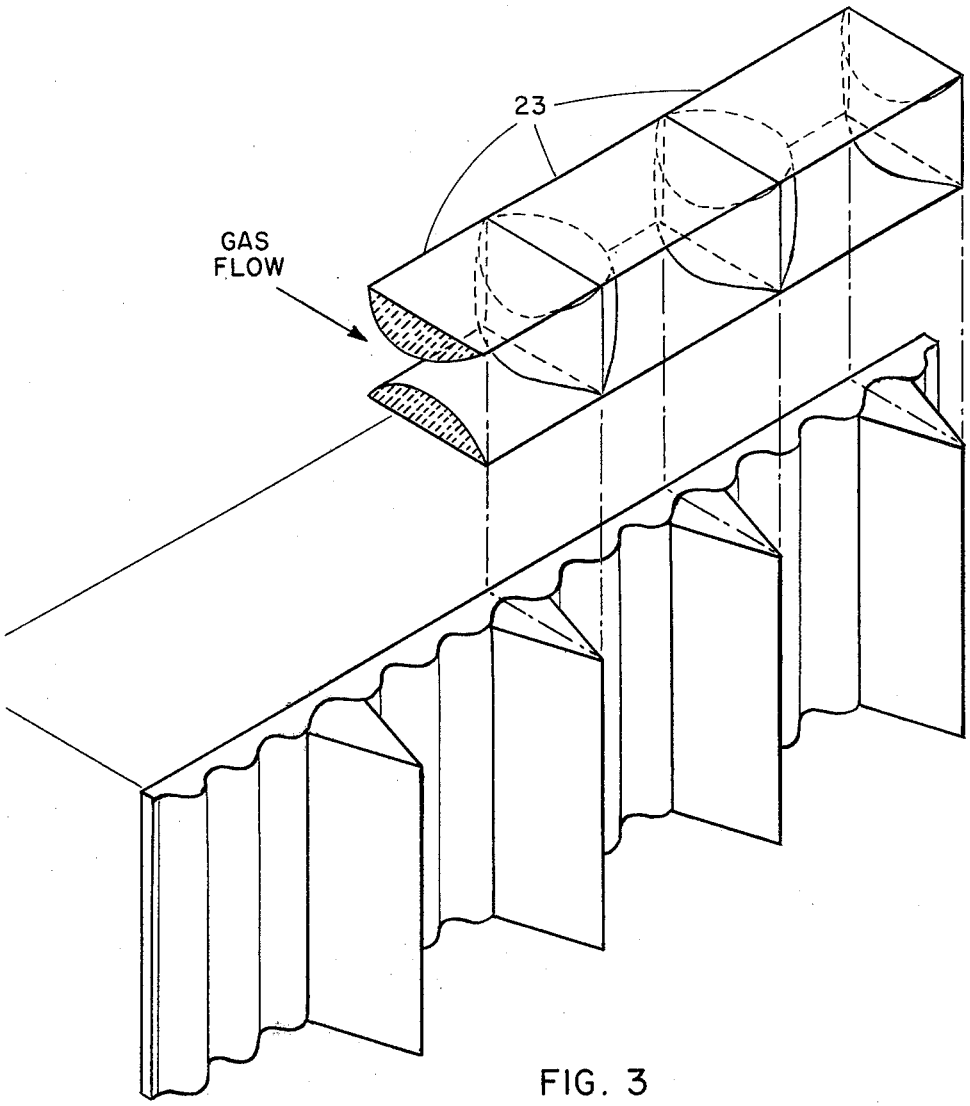
FIG. 3 is a frontal view of a plurality of venturi nozzle blocks lining the passageway between the primary combustion section and the secondary reaction chambers.
Figure 4:
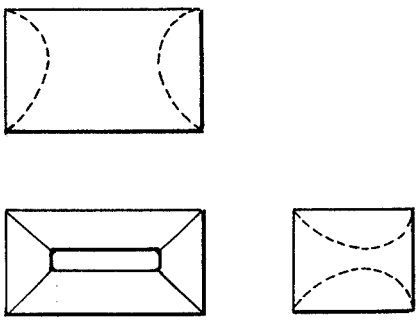
FIG. 4 is an orthographic projection of a venturi nozzle block.

Referring now to the drawings and particularly FIG. 1, the gasification reactor 2 includes an upper pyrolysis section 4, a lower feed opening 6, and a primary combustion section 8 bounded by the top of the pyrolyzed fuel charge 9, a diffusion plate 20 and venturi nozzles 17 and 19. High velocity reaction gases pass through the diffusion plate 20 (FIG. 2) via a plurality of small apertures 22. A pair of lateral passages 10 transfers partially reacted product and gases from the primary combustion section to a pair of oval secondary reaction chambers 12. The passageways contain at least one and preferably a plurality of venturi nozzle blocks 23, shown in FIG. 3 exploded from its base, to accelerate the gases containing partially reacted entrained particles to cause a swirling or curvilinear motion in the secondary reaction chambers 12. The walls 13 and 15, and venturi nozzles 17 and 19 are made of a refractory material (13 and 19 supported by support members 1) and water cooling pipes 49 are embedded in walls 15. Product gas is removed via conduits 14 and sent to a cyclone (not shown) for recovery, and ash and other byproduct solids are removed via conduits 16 containing screw conveyors 18.

Coal or other solid carbonaceous material is fed by means of a plurality of hoppers 26 and screw conveyors 28 (preferably in counter rotating pairs) past flapper gates 25 into rotary valve cavities 27 in which counter rotating valves 24 travel. As depicted in FIG. 1 rotary valves 24 are in an open position whereby fuel is fed into the valve cavities 27. The valves are then rotated downward (i.e., the right numbered valve in a clockwise direction and the left unnumbered valve in a counter-clockwise direction) to gravity feed chamber 29, and open the reactor for charging by the feed piston 30. The flapper gates 25 are closed as the valves are rotated and simultaneously the feed screws are stopped, thus terminating the flow of feed into the valve cavities 27 and feed piston 30 is retracted from closed position 7 to its base position 5 as shown in FIG. 1. While the valves continue rotation, forcing the feed into feed chamber 20, feed piston 30, which is rounded on top to mesh with the valves, is then extended, by hydraulic or other conventional power means, past rotary valves 24, which are now in a closed feed position and the valves are gradually rotated to fully open the channel into the reactor when the feed piston is extended to line 7 so as to allow the piston to travel to line 6 and charge the reactor.

After charging the reactor, the piston is withdrawn while the rotary valves are turned (i.e. the right numbered valve in a counter-clockwise direction and the left unnumbered valve in a clockwise direction) so that a reactor seal is maintained, the fuel not withdrawn, and the rotary valve cavities 27 refilled, thus completing the cycle. Reactor refractory walls 13 are inwardly tapered downward so as to further inhibit feed removal. As the retracting feed piston 30 passes position 7, inert gas such as carbon dioxide is introduced from reservoir 32 via conduit 36, at a pressure greater than that introduced to hoppers 26 by conduit 38 for the purpose of equalizing the pressure in the reactor and further inhibit retraction of the carbonaceous feed from the reactor. In addition, the gas forces the feed into the upper portion of the reactor pyrolysis section 4 for reaction with gas passed through diffusion plate 20 and then into secondary reaction chambers 12.

On the return downward stroke of piston 30, inert gas, residing in the space previously occupied by the piston, is passed via conduit 34 to reservoir 32. Make-up gas is provided via conduit 42 and the system further regulated by means of valve 40. The inert gas is introduced to maintain the gas loop piston assembly at a pressure slightly above the pressure within the primary combustion section 8 and secondary reaction chambers 12.

Preferably a series of counter rotating rotary valves, screw feeds and feed pistons are employed throughout the length of the reactor to accomplish relatively even fuel flow distribution to the reactor.

In operation, hoppers 26 are first filled with coal or other carbonaceous fuel and the reactor placed under draft or reduced pressure and vented to a flare stack (not shown). Fuel gas, preferably natural or liquid petroleum gas, along with excess combustion air is passed via conduit 21 through the diffusion plate aperatures 22 and ignited. The pyrolysis section 4 is filled with fuel. The heat products of combustion pass out of the primary combustion section 8 to heat the secondary combustion chambers 12 and by virtue of their cyclonic or swirling movement contact the heat exchange walls 13 of the pyrolysis section 4. The pyrolysis section is heated to operating temperature (or that temperature at which the pyrolized volatile products will ignite and burn with the excess combustion air) and the fuel gas is gradually reduced when sustained combustion is assured between the volatile products and air or in the case of chars, their ignition temperatures are reached, and then the fuel gas turned off, and oxygen and carbon dioxide are gradually added to the air stream. As combustion of both carbon and volatile constituents continues, the flow of air is reduced and finally stopped when the unit has reached thermal equilibrium at atmospheric pressure with the flow of oxygen and carbon dioxide. The reactor is gradually placed under positive operating pressure in the range of 30 to 225 psig, while fuel feeds and gas flows are adjusted to predetermined operating rates. When the system reaches equilibrium conditions resulting from the predetermined fuel and gas rates, the product gas is passed into a plant process stream, and the use of the flare stack stopped.

The product stream will be principally carbon monoxide and carbon dioxide with some hydrogen, when employing a feed containing char into which carbon dioxide and/or stream is impinged as the feed exits the primary combustion section 4. The composition of product gases is dependent upon fuel feed rates, input gas rates and reactor temperatures, pressures, and resident times. When employing low rank noncaking coals, product gas mixtures containing various fixed hydrocarbon gases will be produced such as methane, ethane, ethylene and acetylene, in addition to carbon monoxide, carbon dioxide and hydrogen.

The secondary reaction chambers 12 are of relatively larger volume to allow for the expansion of the gas from the primary combustion section 8 to provide expansion cooling and thus frozen equilibrium. Water cooling tubes 49 or other suitable heat exchange surfaces embedded in or on refractory walls 15 provide quenching and control of temperature within the secondary reaction chambers 12. In addition, steam is preferably introduced through a multiplicity of nozzles projecting from wall 15 (not shown) which facilitates in cooling and equilibrating the product gas composition while also imparting kinetic energy to the partially burned fuel particles so as to facilitate their removal from the gas phase and their fallout into the ash removal screws 18.

The product gas containing a small amount of ash is swept upwards along the heat exchange surfaces of the support pylons 1 and the refractory wall 13 which is preferably corrugated (FIG. 3), wherein the heat content from the product gas is imparted to these heat exchange surfaces and transferred to the fresh fuel contained in the pyrolysis section 4.

The product gas enters the gas offtake mains 14 and exits from each of the secondary reaction chambers 12 via conduits 14 to cyclones (not shown).

Initial entrainment of the fuel feed particles in the bottom of the reactor and their accelerated movement into the primary combustion section 8 are aided by the inert gas released via conduit 36, moisture contained in the feed and its volatile matter content, in the case of coals.

Conventional materials can be employed to manufacture the reactor diffusor plates such as electrically deposited stainless steel, porous silicon carbide or alumina high temperature insulating brick and stainless steel micro-metallic material. Conventional ceramic refractory materials including high temperature alumina and silicon carbide, alumina castables, carbon steel, and stainless steel may be used for the construction of reactor components.

While the above description and drawings are the best mode known to the applicant, obvious modifications may occur to one of ordinary skill in the art and accordingly the invention is to be limited only by the appended claims.

What is claimed is:

1. A gasification reactor comprising:

(a) a vertically oriented chamber comprising a pyrolysis section, a lower feed opening, and a primary combustion section located above said pyrolysis section with an aperature for receiving reaction gases, a plurality of lateral passages near the top of the primary combustion section for transferring partially reacted product and gases to a plurality of secondary reaction chambers;

(b) said secondary reaction chambers, having a first conduit for removing product gases and a second conduit for removing by-product solids;

(c) at least two contiguous, horizontally arranged counter rotating partially cut away rotary valves having a sinusoidal like surface, each valve contained within a circular channel, and positioned below said feed opening;

(d) a feed piston contained within a vertical channel extending from below said valves and through a part of said rotary valves channel and communicating with said feed opening, said piston movable up and down from a base position in said channel to said feed opening;

(e) means for feeding carbonaceous solid fuel to said rotary valves;

(f) means for rotating said rotary valves;

(g) means for advancing and retracting said feed piston;

(h) means for recovering said product gases, and by-product solids;

(i) means for adding reaction gases to said primary combustion section; and (j) means for pressurizing said reactor.

2. The apparatus of claim 1 wherein the rotary valves are adapted to move in synchronization with the feed piston so as to continuously maintain a reactor seal.

3. The apparatus of claim 2 wherein the top of the feed piston is shaped to conform with the sinusoidal like shape of the rotary valves.

4. The apparatus of claim 1 wherein the vertically oriented chamber is inwardly tapered downward to inhibit feed retraction.

5. The apparatus of claim 1 wherein the aperature for receiving reaction gases is an elongated aperature in the top of said primary combustion section extending substantially the width of the reactor.

6. The apparatus of claim 1 wherein the means for adding reaction gases to said primary combustion section comprises a diffusion plate having a plurality of small aperatures.

7. The apparatus of claim 1 wherein each lateral passage leading from the primary combustion section to a secondary reaction chamber contains at least one venturi nozzle to accelerate the speed of the gases.

8. The apparatus of claim 1 wherein each lateral passage leading from the primary combustion section to a secondary reaction chamber contains a plurality of venturi nozzles to accelerate the speed of the gases.

9. The apparatus of claim 1 wherein the means for pressurizing the reactor include means to introduce inert gas in said piston feed channel below said rotary valves and above said feed piston.

10. A feed apparatus comprising:

(a) a pair of contiguous horizontally aligned counter rotating partially cut away rotary valves having a sinusoidal like surface, each valve contained within a circular channel to which feed can be gravity fed when the valves are in an open position, and the feed entrance closed and the channel cleared with the feed deposited at a lower level when the valves are rotated and (b) a vertical channel and a feed piston movable in said vertical channel extending from below said valves to an area above said valves, said circular channels extending into said vertical channel to alternatively open and close said vertical channel, to said piston when said valves are rotated, said piston movable from a retracted base position below said valves to an area above said valves when said vertical channel is open.

* * * * *